United States Patent [19]

Burge

[11] 4,075,952

[45] Feb. 28, 1978

[54] SCISSOR-TYPE SLIDE GATE OPENER

[75] Inventor: Ralph Clarence Burge, Christiana, Del.

[73] Assignee: E. I. Du Pont de Nemours and Company, Wilmington, Del.

[21] Appl. No.: 701,613

[22] Filed: Jul. 1, 1976

[51] Int. Cl.[2] ..... B61D 7/26

[52] U.S. Cl. ..... 105/282 R; 105/299

[58] Field of Search ..... 105/282 R, 282 P, 299, 105/304; 269/242; 49/348, 351, 353

[56] References Cited

U.S. PATENT DOCUMENTS

| | | | |
|---|---|---|---|
| 1,644,809 | 10/1927 | Ackerman | 49/351 |
| 2,422,773 | 6/1947 | Colwill | 269/242 X |
| 3,183,852 | 5/1965 | Fritz | 105/282 R |

FOREIGN PATENT DOCUMENTS

| | | | |
|---|---|---|---|
| 110,363 | 4/1940 | Australia | 49/351 |

*Primary Examiner*—Albert J. Makay

[57] ABSTRACT

An apparatus for opening a gear activated scissor-type car pocket opener. The apparatus includes a shaft, slide members mounted on opposite outboard lengths of the shaft, links which fit into sockets connected to the gears of the opener and which are mounted on the slide members so that the links are free to move axially of the shaft, and means for axially moving the slide members toward the midlength of the shaft.

1 Claim, 2 Drawing Figures

SCISSOR-TYPE SLIDE GATE OPENER

BACKGROUND OF THE INVENTION

This invention relates to an apparatus for opening a scissor-type car pocket opener which is operated by a pair of gears.

Certain types of railway hopper cars are equipped with discharge means (e.g., chute) or opening located at the lower end of the car. The discharge means is opened or closed by a slide gate which is located underneath the hopper car and is movable transversely of the discharge means. When the slide gate is opened, material from the hopper is easily unloaded from the railway car by the force of gravity. One common device used to open the slide gate is a scissor-type car pocket opener. The scissor-type opener has a pair of gear racks which are mounted underneath the gate and are activated by pinions, thus causing the gate to move in a straight direction. Conventionally, the gears are activated by inserting iron bars into openings on each side of the gears and pushing the bar to turn the gears so that the slide gate will open. This method of opening the scissor-type car pocket opener requires at least two operators and presents a dangerous threat of injury to the operators. This invention provides an apparatus to activate the scissor-type opener which can be operated by one man and which reduces the threat of injury to the operator.

SUMMARY OF THE INVENTION

This invention relates to an apparatus for opening a gear-activated scissor-type car pocket opener. The apparatus of this invention comprises guide means, slide members mounted on opposite outboard lengths of said guide means, links adapted to fit into radial sockets in the gears of the opener, said links pivotally mounted on opposite outboard lengths of said slide members so that said links are free to move axially of said guide means, and means attached to said guide means for axially moving said slide members toward the mid-length of said guide means.

The present invention further relates to an apparatus for opening a gear-activated scissor-type car pocket opener comprising a rotatable, cylindrical shaft wherein said shaft has a right-hand threaded section on one outboard length and a left-hand threaded section on the opposite outboard length, a pair of nuts threadably mounted on opposite ends of said shaft, links adapted to fit into radial sockets in the gears of the opener, said links pivotally mounted at one end on said nuts so that said links are free to move axially of the shaft, and means attached to said shaft for rotating said shaft around its axis whereby rotation of said shaft results in nonrotational axial movement of said nuts toward the midlength of said shaft.

DESCRIPTION OF THE PREFERRED EMBODIMENTS

Figure 1:
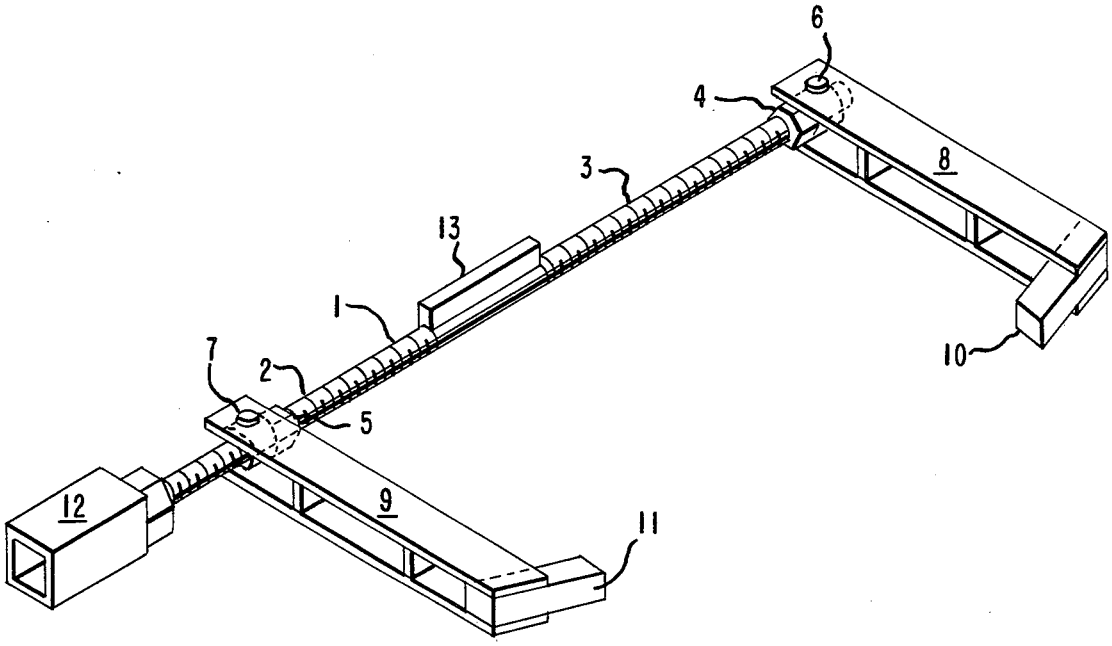
FIG. 1 is a view of a preferred embodiment of the apparatus of the present invention.

Referring to FIG. 1, the apparatus of the present invention is comprised of a rotatable, cylindrical shaft 1. Shaft 1 has right-hand threaded outboard length 2 from one end to plate 13 and a left-hand threaded outboard length 3 from the opposite end to plate 13. Nut 5 is threadably mounted on outboard length 2 and nut 4 is threadably mounted on outboard length 3. Links 8 and 9 are pivotally mounted on nuts 4 and 5, respectively. Links 8 and 9 are pivoted at points 6 and 7, respectively, so that they are free to move only axially of the shaft. The ends of the links opposite the pivoted ends contain metal blocks 10 and 11 which are adapted to fit into the sockets in the gears on the scissor-type pocket car opener. Socket 12 is attached to shaft 1 so that when socket 12 is rotated in a clockwise direction, shaft 1 rotates and causes links 8 and 9 to move in opposite direction along the axis of shaft 1 toward plate 13. Socket 12 can be easily rotated by connecting it to a rotating pneumatic device. Plate 13 is a stop device which limits the inward movement of nuts 4 and 5 along shaft 1.

Figure 2:
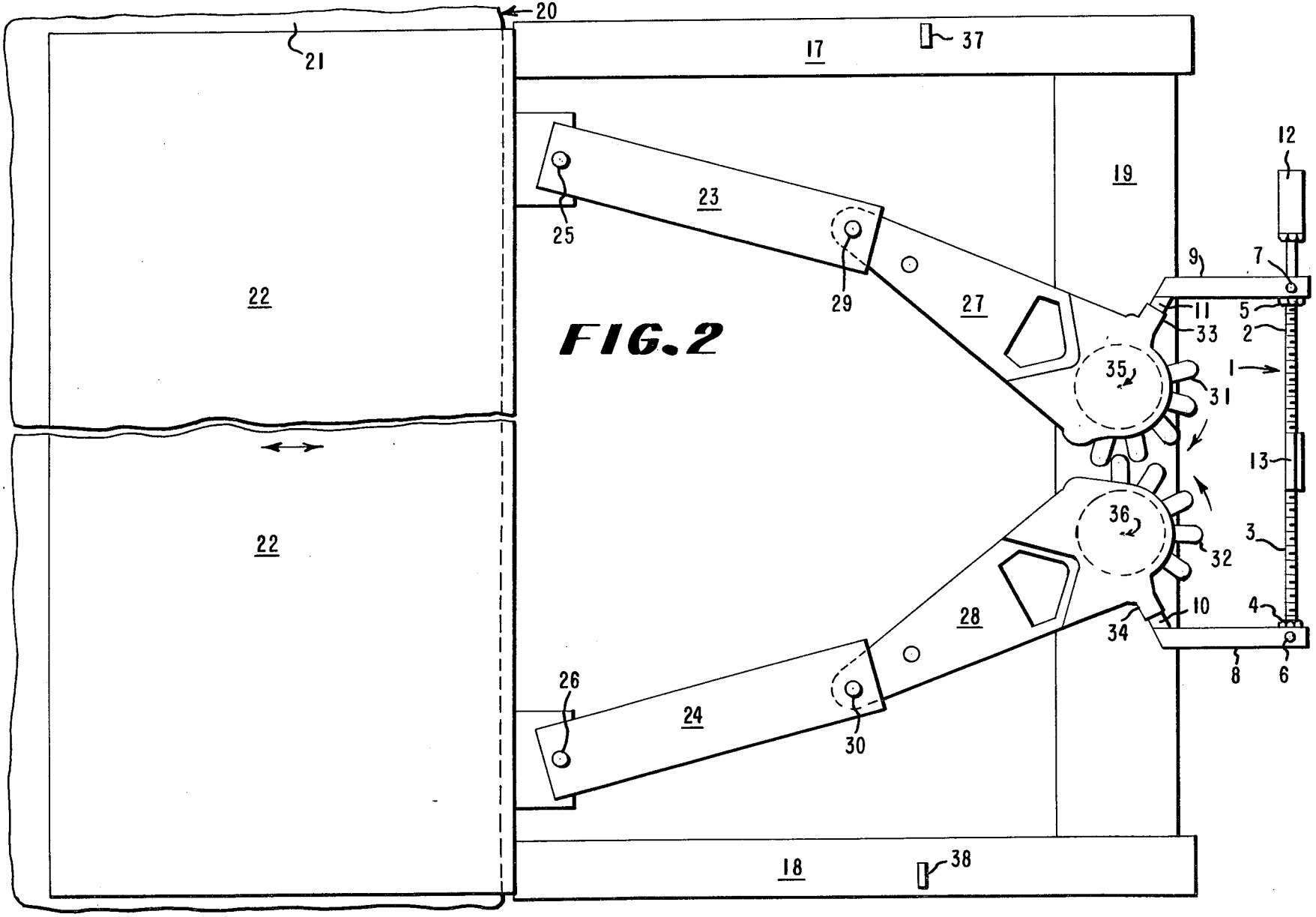
FIG. 2 is a plan view of a scissor-type car pocket opener with the slide gate in the closed position and with the apparatus of the present invention in postion for opening the slide gate. This type of opener is common on New Jersey Central railway hopper cars. The apparatus of the present invention as shown in FIG. 2 is not drawn to scale in relation to the opener.

Referring to FIG. 2, reference number 20 indicates the lower end portion of a hopper, for example, of a ralroad hopper car, generally of the center-flow type. Associated with hopper 20 is a hopper outlet assembly 21, a slide gate 22, and frame members 17, 18 and 19.

The operating mechanism for effecting movement of slide gate 22 between closed and opened positions are arms 23 and 24 which are pivotally connected at one end to slide gate 22 at points 25 and 26, respectively. The end, respectively, of arms 23 and 24 distal to the slide gate is pivotally connected to the proximal end of members 27 and 28, respectively, at points 29 and 30, respectively. Gears 31 and 32 and slots 33 and 34 are mounted on the distal end of members 27 and 28. Gears 31 and 32 are pinned into frame member 19 at points 35 and 36, respectively so that the gears can rotate. When gear 31 is rotated in a clockwise direction and gear 32 is rotated in a counterclockwise direction, the ends of members 27 and 28, which are pivotally connected to arms 23 and 24, respectively, are caused to move toward frame member 19. This pulls arms 23 and 24 toward frame member 19 which moves slide gate 22 into the opened position.

The apparatus of FIG. 1 of the present invention is used to rotate gear 31 and gear 32 in opposite directions. As shown in FIG. 2, blocks 10 and 11 of the apparatus are inserted into sockets 33 and 34. When shaft 1 is rotated blocks 10 and 11 move axially of shaft 1 and toward its mid-length. Blocks 10 and 11 cause gears 31 and 32 to rotate in opposite directions, thus causing slide gate 22 to open.

Stop tabs 37 and 38 prevent slide gate 22 from travelling beyond these points.

I claim:

1. A discharge outlet assembly for a hopper car in which a slideable gate is moved between an open and closed position by a pair of crank arms which move links to operate the slide gate, said crank arms being connected to meshing gear sectors containing a socket which gears cause conjoint rotation of the crank arms for moving said slide gate between an open and closed position, the improvement comprising a motion transducer adapted to drive each of the paired gears of the meshing gear sector said motion transducer comprising a rotatable, cylindrical shaft wherein said shaft has a right-hand threaded section on one outboard length and a lefthand threaded section on the opposite outboard length, a pair of threaded members engaged on opposite sides of the threaded shaft so that rotation of the shaft moves said threaded members in opposite directions on said threaded shaft, a link pivotally mounted on each threaded member, and a block adapted to fit into the socket of said gear sectors, said block being at the end of said link distal to said threaded member.

* * * * *